United States Patent [19]

Seidel et al.

[11] 4,170,060

[45] Oct. 9, 1979

[54] SHEAR-HEAD FOR DRYSHAVERS

[75] Inventors: Gunther Seidel, Frankfurt am Main; Christian Schmieder, Schwalbach, both of Fed. Rep. of Germany

[73] Assignee: Braun Aktiengesellschaft, Frankfurt am Main, Fed. Rep. of Germany

[21] Appl. No.: 825,426

[22] Filed: Aug. 17, 1977

[30] Foreign Application Priority Data

Aug. 19, 1976 [DE] Fed. Rep. of Germany ..... 2637302

[51] Int. Cl.[2] ..... B26B 19/04

[52] U.S. Cl. ..... 30/43.92; 30/346.51

[58] Field of Search ..... 30/43.8, 43.9, 43.91, 30/43.92, 346.51, 34.1

[56] References Cited

U.S. PATENT DOCUMENTS

| | | | |
|---|---|---|---|
| 3,694,916 | 10/1972 | Harms | 30/346.51 X |
| 3,909,938 | 10/1975 | Brenneman | 30/34.1 |

FOREIGN PATENT DOCUMENTS

| | | | |
|---|---|---|---|
| 1801545 | 4/1969 | Fed. Rep. of Germany | 30/43.91 |
| 2307646 | 8/1974 | Fed. Rep. of Germany | 30/346.51 |
| 1392594 | 12/1965 | France | 30/346.51 |
| 1279313 | 6/1972 | United Kingdom | 30/346.51 |

*Primary Examiner*—Gary L. Smith

*Attorney, Agent, or Firm*—Michael J. Striker

[57] ABSTRACT

A shear-head for a dryshaver has a cupped frame in the interior space of which the cutter blade or blades of the dryshaver become located when the shear-head is connected to the dryshaver housing. An opening of the frame is spanned by an arcuately bowed, flexible apertured shear foil through which beard stubble extends into contact with the cutter blade or blades. Inner surfaces of the frame are provided with recesses in which mounting plates are lodged. These mounting plates have projections that are engageable with edge portions of the shear foil to hold the latter detachably on the frame.

5 Claims, 8 Drawing Figures

SHEAR-HEAD FOR DRYSHAVERS

BACKGROUND OF THE INVENTION

1. Field of Invention

The present invention relates to dryshavers, and more particularly to shear-heads for dryshavers.

2. The Prior Art

Dryshavers are known which have a releasable shear-head that is either pivoted to or snap-coupled with the housing of the dryshaver. These shear-heads have a cupped frame that is provided with an opening. A highly flexible apertured shear foil spans the opening; when the shear-head is in operative position on the dryshaver housing the cutter blade or blades of the dryshaver are located in the interior space of the frame and cooperate with the shear foil to cut beard stubble which extends through the shear foil to the interior.

A construction of this type is disclosed, e.g., In German Pat. No. 1,168,796 where the frame is provided with inner projections to which the shear foil is secured by pushing the projections through openings in edge portions of the shear foil. The advantage of this construction is that the shear foil can be readily mounted and dismounted even by persons having no mechanical skill (e.g., to replace a damaged foil with a new one, or to exchange the foil for another one having larger or smaller apertures (without danger of damage to the relatively fragile foil.

Particularly if the projections are given a conically shaped head, the attaching and detaching of the shear foil can be effected analogously to a snap-coupling. By appropriately configurating the projections and the associated openings in the shear foil, the foil can be secured to the frame in such a manner that it can shift relative to the frame (against the friction of its contact therewith) in different directions under the pressure of its contact with the skin of a user, so as to adjust itself to different beard and/or skin conditions.

The frames for these shear-heads are manufactured in very large quantities, by casting. Considering the mass-production nature of their manufacture, it would be uneconomically difficult to form the projections integrally (of one piece) with the frame during the casting of the same. The industry practice is, therefore, to manufacture the projections as separate elements and to provide holes in the frame through which these elements are secured by means of screws, rivets or in analogous manner.

This, however, brings with it the disadvantage that the outer surfaces of the frame of the shear-head are no longer uninterrupted. Instead, screw heads, rivet heads or the like are now present and form corners or recesses in which dirt can accumulate, thus making it difficult to keep the dryshavers properly clean. Also, the appearance of the dryshaver is detrimentally influenced by this.

SUMMARY OF THE INVENTION

It is an object of the invention to overcome prior-art disadvantages.

More particularly, it is an object of the invention to provide an improved shear-head for dryshavers which avoids these disadvantages.

Another object of the invention is to provide such a shear-head wherein the outer frame surfaces can be smooth and uninterrupted.

Still a further object is to provide a shear-head of the type in question which can be readily produced in large quantities.

In keeping with these objects and with still others which will become apparent hereafter, one feature of the invention resides in a shear-head for dryshavers which, briefly stated, comprises a cupped frame having an interior space bounded by inner frame surfaces, and an opening communicating the interior space with the exterior of the frame; and means for detachably mounting a flexible apertured shear foil on the frame so that it arcuately spans the opening, the mounting means comprising at least one recess in each of two oppositely located ones of the inner frame surfaces, and at least a pair of mounting plates each matingly received in one of the recesses and each provided with at least one projection extending inwardly of the interior space and to which an edge portion of the shear foil is connectable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
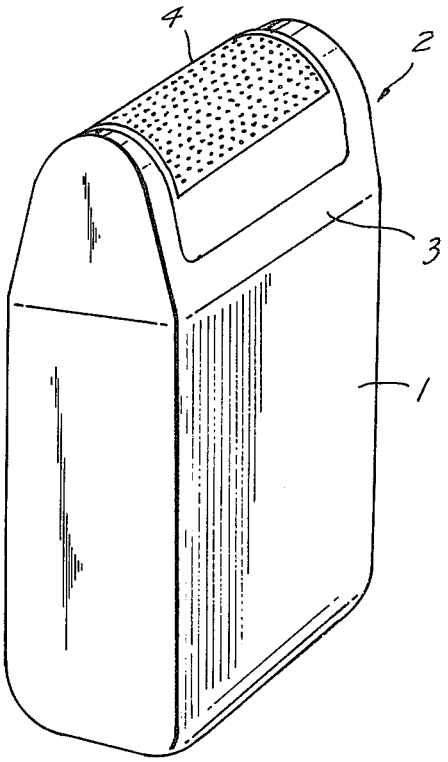
FIG. 1 is a perspective view of a dryshaver using a shear-head according to the invention.

A dryshaver is shown in toto in FIG. 1. It has a housing 1 provided with a shear-head 2; the latter is composed of a cupped frame 3 (usually completely detachable from the housing or connected to the same so that it can be pivoted to an inoperative position) which carries an arched shear foil 4. The housing 1 of course accommodates a drive and has a blade or blades which are located in the interior of the shear-head 2 and cooperate with the foil 4. No details of the drive and blade or blades are given; they are known per se.

Figure 3:
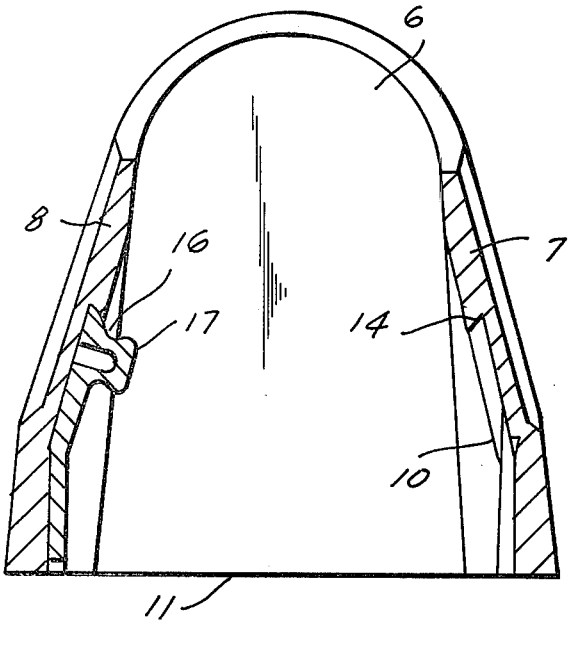
FIG. 3 is a cross-section taken on line III—III of FIG. 2.
Figure 2:
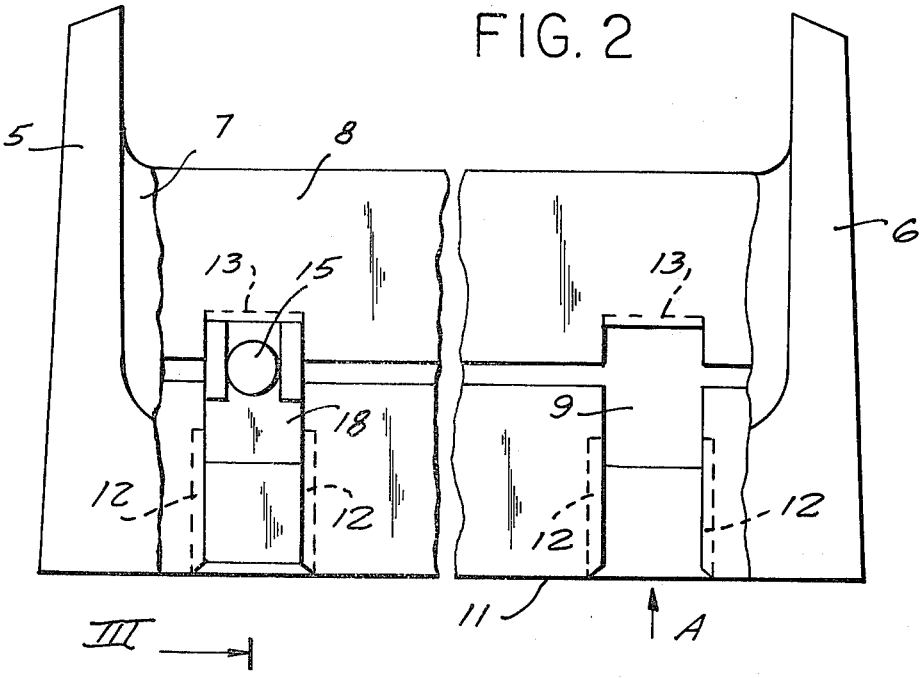
FIG. 2 is a side view, partly in section, of a shear-head frame.
Figure 4:
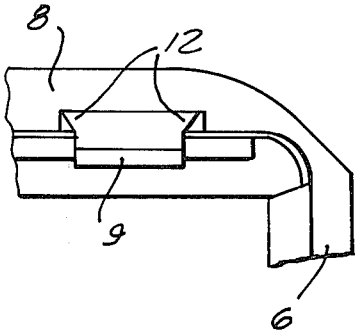
FIG. 4 is a fragmentary view of the shear-head frame, seen in the direction of arrow A in FIG. 2.
Figure 6:
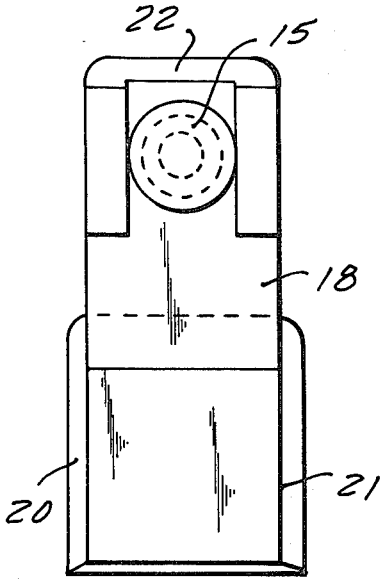
FIG. 6 shows the detail of FIG. 5, as seen in the direction of the arrow B.
Figure 5:
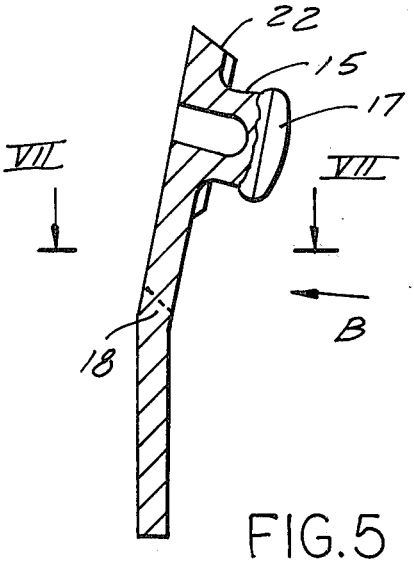
FIG. 5 shows an enlarged sectional detail of FIG. 2.

The cupped frame 3 has two endwalls 5, 6 and two longitudinally extending sidewalls 7, 8 (see FIGS. 2 and 3). The inner surface of the sidewall 8 is provided with recesses 9 (FIG. 2) and the inner surface of the sidewall 7 with recesses 10. These recesses 9, 10 are open to the base plane 11 of frame 3 (FIG. 3); at least the lower portion of each of these recesses is undercut to form a dovetail-shaped guide 12 (the configuration of the undercut could also be other than dovetail-shaped). The upper ends of the recesses are also provided with undercuts 13, 14, respectively.

The shear foil 4 is mounted on the frame 3 in bowed or arched condition (compare FIG. 1). This is usually done by providing its marginal portions (which overlie the inner surfaces of sidewalls 7, 8) with openings into which projections 15, 16 (for simplicity only one projection and recess is shown per sidewall in FIG. 2) extend. These projections 15, 16 are, in the illustrated embodiment, provided with conical heads 17 so as to obtain a "snap" type engagement with the shear foil 4.

The projections 15, 16 are each secured to (or, as here illustrated, of one piece with) respective mounting plates 18, 19. The lower sections and the upper ends of these mounting plates have bevelled edges 20, 21, 22, respectively. The projections may be provided anywhere on the mounting plates; by way of example they are shown on the upper halves of the plates. To secure the projections 15, 16 to the inner surfaces of the walls 7, 8 the mounting plates 18, 19 are inserted from below into the respective recesses 9, 10 (see FIG. 3) until the upper bevelled edge 22 of the respective plate 18, 19 enters into the undercut 13 of the associated recess 9, 10 and thus secures the mounting plate against movement.

Figure 8:
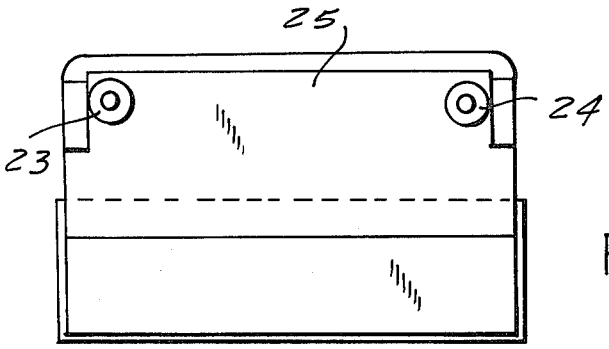
FIG. 8 illustrates a variation of the embodiment in FIGS. 5 to 7.
Figure 7:
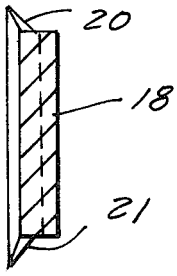
FIG. 7 is a sectional view, showing the detail of FIG. 5 and taken on line VII—VII of that Figure.

Of course, it is not necessary for each projection 15, 16 to have its own mounting plate 18 or 19, respectively. FIG. 8 shows that a single mounting plate 25 may be provided with two (or more) projections 23, 24. Evidently, in lieu of the two recesses of the preceding Figures each sidewall 7, 8 will then be provided with only one larger recess (not shown in detail) which is dimensioned to receive the respective larger mounting plate 25 but has the same structure and purpose as the recesses 9, 10. The insertion of the plates 25 into their associated recesses also takes place in the same manner as described with reference to the plates 18, 19. Generally, the use of a separate mounting plate for each individual projection will be advisable if the thickness of walls 7, 8 is relatively small; if the walls are relatively thick, plates according to FIG. 8 will usually be preferred.

The invention will be seen to locate the projections for retaining the shear foil 4, on the inner surfaces of the side walls 7, 8. This completely eliminates the need for screw heads, rivet heads or other shear foil securing portions at the exterior of the shear-head 2 and avoids any "dirt traps" at the exterior.

Moreover, the invention also simplifies the manufacture of the frame 3, because it eliminates the need to form (e.g., by drilling) holes for screws or rivets in the frame. The recesses for the mounting plates can, of course, be formed in simple manner during the manufacture of the frame itself.

While the invention has been illustrated and described as embodied in a shear-head for dryshaver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A shear-head for dryshavers, comprising a cupped frame having an interior space bounded by inner frame surfaces, and an opening communicating said interior space with the exterior of said frame; a flexible apertured shear foil; and means forming a unit with said frame for detachably mounting said flexible apertured shear foil on said frame so that it arcuately spans said opening, said mounting means comprising at least one recess in each of two oppositely located ones of said inner frame surfaces, and at least a pair of mounting plates each matingly received in one of said recesses, said recesses and the associated mounting plates being provided with interengageable undercut portions, each mounting plate being provided with at least one projection extending from the respective mounting plate inwardly of said interior space and to which an edge portion of the shear foil is connected so that said mounting plates remain stationary in place in the corresponding recesses upon withdrawing of the shear foil from said opening of the frame.

2. A shear-head as defined in claim 1, wherein said undercut portions are of dove-tailed configuration.

3. A shear-head as defined in claim 1, wherein each of said mounting plates is provided with two transversely spaced projections.

4. A shear-head as defined in claim 1, wherein each of said projections is of one piece with the respectively associated mounting plate.

5. A shear-head for dryshavers, comprising a cupped frame having an interior space bounded by inner frame surfaces, and an opening communicating said interior space with the exterior of said frame; a flexible apertured shear foil; and means forming a unit with said frame for detachably mounting said flexible apertured shear foil on said frame so that it arcuately spans said opening, said mounting means comprising two transversely spaced recesses provided in each of said two oppositely located ones of said inner frame surfaces, and two pairs of mounting plates each matingly received in one of said recesses and each provided with at least one projection extending from the respective mounting plate inwardly of said interior space and to which an edge portion of the shear foil is connected so that said mounting plates remain stationary in place in the corresponding recesses upon withdrawing of the shear foil from said opening of the frame.

* * * * *